US007393218B1

(12) United States Patent
Pavlovic et al.

(10) Patent No.: US 7,393,218 B1
(45) Date of Patent: Jul. 1, 2008

(54) CONNECTOR ASSEMBLY WITH OVERMOLDED SHIELDED HOUSING

(75) Inventors: Siobadan Pavlovic, Canton, MI (US); David S. Menzies, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/687,979

(22) Filed: Mar. 19, 2007

(51) Int. Cl.
*H01R 4/66* (2006.01)

(52) U.S. Cl. ..... 439/97; 439/98; 439/939

(58) Field of Classification Search ..... 439/97, 439/98, 271, 559, 578, 587, 606, 874; 174/89
See application file for complete search history.

(56) References Cited

U.S. PATENT DOCUMENTS 4,579,405 A * 4/1986 Hirooka ..... 439/106
5,906,513 A * 5/1999 Peterson et al. ..... 439/607
6,045,390 A * 4/2000 Metz et al. ..... 439/405
6,422,899 B1 * 7/2002 Miyazaki ..... 439/559
6,454,601 B1 * 9/2002 Vaitkus et al. ..... 439/578
6,583,352 B2 * 6/2003 Fukushima et al. ..... 174/373
6,648,674 B1 * 11/2003 Dobler ..... 439/460
6,793,532 B2 * 9/2004 Saito et al. ..... 439/610
6,953,357 B2 * 10/2005 Fukushima et al. ..... 439/271
7,168,971 B2 * 1/2007 Manson et al. ..... 439/271

* cited by examiner

*Primary Examiner*—Thanh-Tam T Le
(74) *Attorney, Agent, or Firm*—Earl LaFontaine

(57) ABSTRACT

A connector assembly is provided comprising a device including a conductive device shroud forming a device plug receptacle. A cable element includes a first stripped cable end portion exposing an internal cable conductor and a third stripped cable portion exposing a cable ground shield. A terminal element is mounted to the first stripped cable end portion. A ground busbar includes a cable mount end mounted to the third stripped cable portion and a ground terminal end. A conductive overmolded connector body is molded covering at least a portion of said third stripped cable portion and comprising a connector plug portion configured to fit within the device plug receptacle. The first stripped cable end portion protrudes out of the connector plug portion and the ground terminal end protrudes outside the conductive overmolded connector body such that the ground terminal end is placed in electrical communication with the conductive device shroud when the connector plug portion is placed within the device plug receptacle.

20 Claims, 2 Drawing Sheets

CONNECTOR ASSEMBLY WITH OVERMOLDED SHIELDED HOUSING

TECHNICAL FIELD

The present invention relates generally to a connector housing with an overmolded housing and more particularly to a connector housing with improved shielding.

BACKGROUND OF THE INVENTION

Automotive environments provide an extensive array of challenges towards engineering design. The environments are replete with caustic materials, liquids, and temperatures that challenge even the basics of operational assemblies. One such arena is that of electrical connectors. Electrical connectors play an ever increasing role in automotive assemblies. They communicate the power, signals, and transmissions that provide functionality to automotive systems. They are, however, sensitive to environmental damage or interference.

A known approach to addressing these environmental concerns in connector design is to increase robustness and add complex sealing configurations. These approaches add considerably to the cost and weight of connector assemblies. In a design field wherein low cost and low weight is prized, such approaches are often less than desirable. Additionally, as the complexity of connector sealing designs is increased, potential failures are often also increased. Finally, many sealing connector designs fail to address the significant issues involved with electrical shielding. As the number of electronic components within a vehicle increases, interference due to electrical leakage represents a growing concern.

As such it would be highly desirable to have a connector assembly that could be simply and efficiently constructed. It would also be highly desirable for such a connector assembly to provide improved sealing characteristics in combination with design simplicity. Finally, it would be highly desirable to have such a connector assembly that provided improved shielding characteristics.

SUMMARY OF THE INVENTION

In accordance with the desires of the present invention a connector assembly is provided comprising a device including a conductive device shroud forming a device plug receptacle. A cable element includes a first stripped cable end portion exposing an internal cable conductor and a third stripped cable portion exposing a cable ground shield. A terminal element is mounted to the first stripped cable end portion. A ground busbar includes a cable mount end mounted to the third stripped cable portion and a ground terminal end. An overmolded connector body is molded covering at least a portion of said third stripped cable portion and comprising a connector plug portion configured to fit within the device plug receptacle. The first stripped cable end portion protrudes out of the connector plug portion and the ground terminal end protrudes outside the overmolded connection body such that the ground terminal end is placed in electrical communication with the conductive device shroud when the connector plug portion is placed within the device plug receptacle.

Other objects and features of the present invention will become apparent when viewed in light of the detailed description and preferred embodiment when taken in conjunction with the attached drawings and claims.

DESCRIPTION OF PREFERRED EMBODIMENTS

Figure 3:
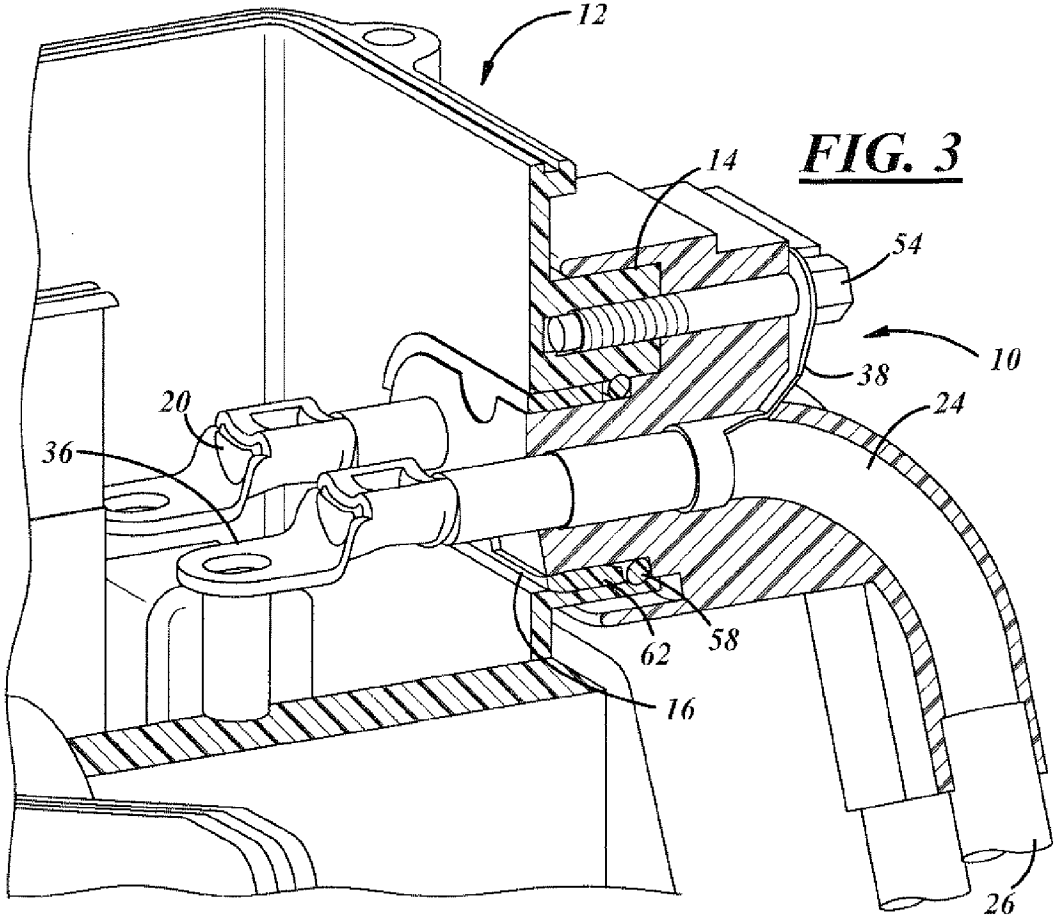
FIG. 3 is a cross-sectional illustration of the connector assembly illustrated in FIG. 1 the illustration depicting installation into a device.
Figure 1:
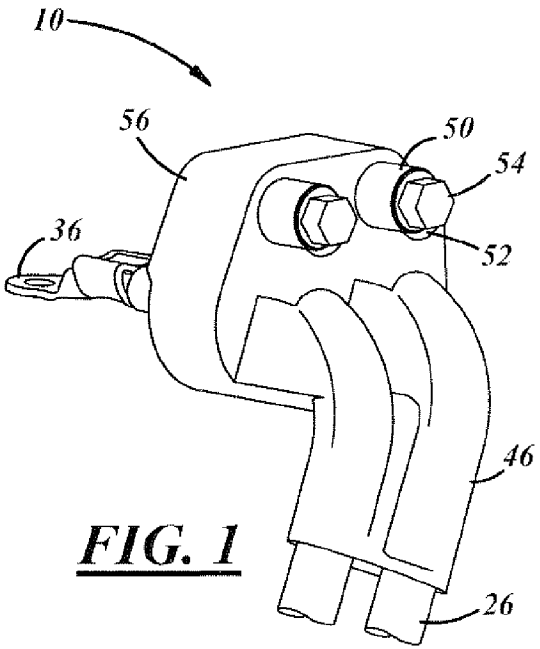
FIG. 1 is an illustration of a connector assembly in accordance with the present invention.
Figure 2:
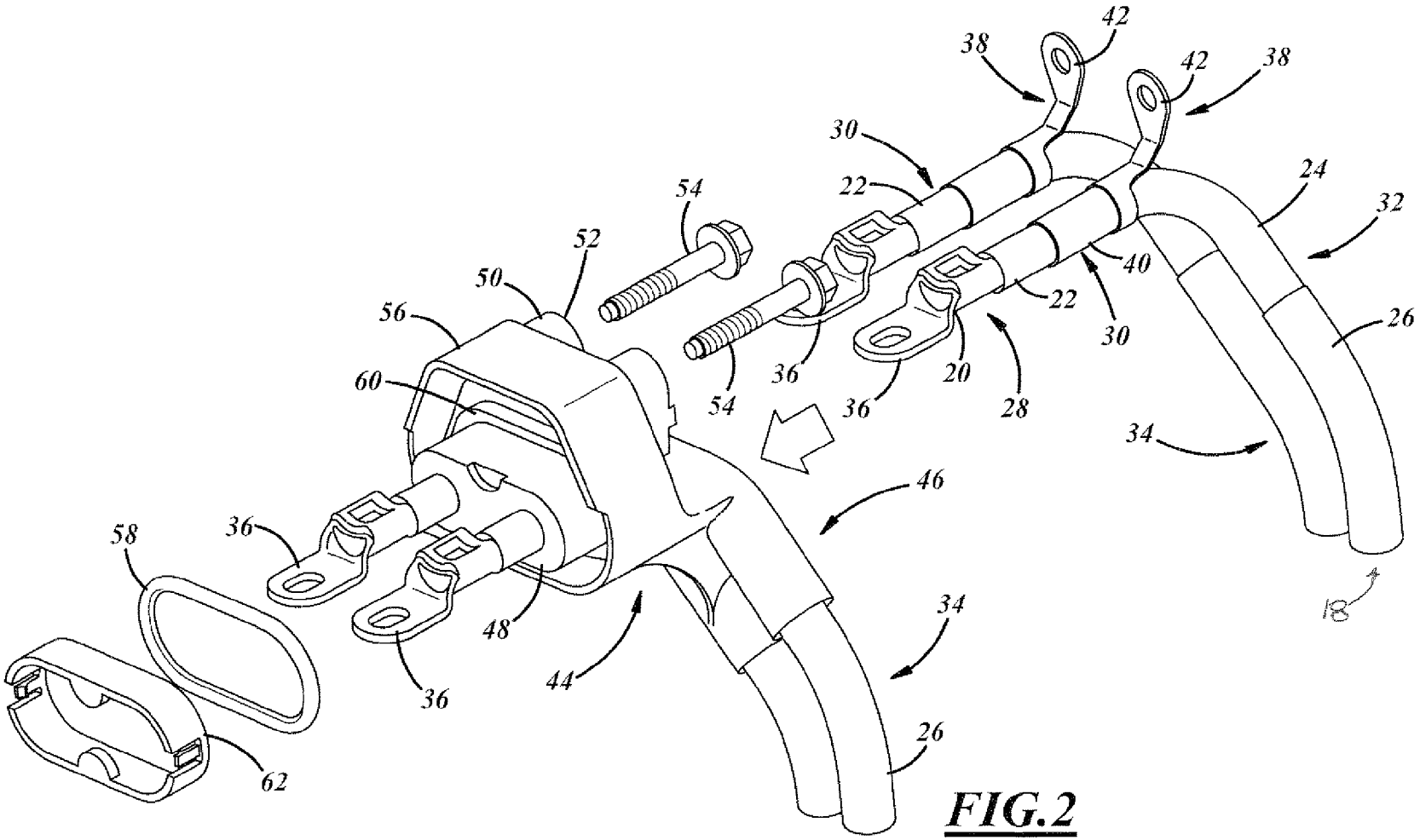
FIG. 2 is an exploded view illustration of the connector assembly illustrated in FIG. 1.

Referring now to FIGS. 1 and 2, which are illustrations of a connector assembly 10 in accordance with the present invention. The connector assembly 10 is configured for use with a device 12 having a conductive device shroud 14 forming a device plug receptacle 16 (see FIG. 3). In the automotive environment, a wide plurality of devices 12 requiring the electrical communication provided by the connector assembly 10 are contemplated. The present invention provides a unique approach to both connecting and shielding these devices 12.

The connector assembly 10 is comprised of at least one cable element 18. In the illustrations, a pair of cable element 18 is illustrated, however, a variety of cable configurations are contemplated. The cable element 18 preferably consists of an internal cable conductor 20 for main electrical communication. A cable conductor insulator 22 surrounds the internal cable conductor 20 over the length of the cable element 18. A ground cable shield 24 in turn surrounds the cable conductor insulator 22. The ground cable shield 24 provides grounding communications to work in conjunction with the internal cable conductor 20 for electrical operations. A cable outer insulator 26 surrounds the ground cable shield 24. It should be understood that in light of the present disclosure, a variety of modifications to the cable element 18 may become apparent including, but not limited to increasing or decreasing the number of different operational and insulating layers.

The cable element 18 includes a first stripped cable end portion 28 wherein the internal cable conductor 20 is exposed. A variety of cable stripping or manufacturing techniques may be utilized to achieve this exposure. The cable element further includes a second stripped cable portion 30 positioned adjacent the first 28 wherein the cable conductor insulator 22 is exposed. A third stripped cable portion 32 adjacent the second 30 allows for the exposure of the ground cable shield 24. Finally, an unstripped cable portion 34 extends from the third portion 32 over the remaining length of the cable element 18. The important aspect of this configuration is that their remains at least a portion with the internal cable conductor 20 exposed and at least a portion with the ground cable shield 24 exposed.

A terminal element 36 is mounted on the first stripped cable end portion 28. Although this may be accomplished in a variety of fashions, in one embodiment the terminal element 36 is crimped onto the first stripped cable end portion 28. A ground busbar 38 is also mounted to the cable element 18. The ground busbar 38 is preferably formed from a low resistance material to provide control of grounding resistance for the ground cable shield 24. The ground busbar 38 is comprised of a cable mount end 40 and a ground terminal end 42. The cable mount end 40 is preferably crimped onto the third stripped cable portion 32 such that the ground busbar 38 is placed in electrical communication with the ground cable shield 24.

After mounting of the ground busbar 38, a conductive overmolded connector body 44 is overmolded on top of the cable element 18. The conductive overmolded body 44 is preferably overmolded such that is encapsulates the cable element 18 from at least a portion of the unstripped cable portion 34 to at least a portion of the second stripped cable portion 30. The conductive overmolded connector body 44 is preferably formed using a conductive polymer. Shielding is achieved by use of such conductive polymer materials as the conductive overmolded connector body 44 generates electrical communication between the ground cable shield 24, the connector body 44, and ground.

The conductive overmolded connector body 44 is preferably comprised of a wire arm surround portion 46 covering at least a portion of the unstripped cable portion 34. The wire arm surround portion 46 extends into a connector plug portion 48 which covers at least a portion of the second stripped portion 30. The connector plug portion 48 is shaped and configured to fit within the device plug receptacle 16. The conductive overmolded connector body 44 may also include a connector bolt tower portion 50 having a tower bolt receiving surface 52. The connector bolt tower portion 50 is configured to house a conductive connector bolt 54 which may be utilized to secure the conductive overmolded connector body 44 to the conductive device shroud 14. During the overmolding of the conductive overmolded connector body 44, it is contemplated that the ground terminal end 42 of the ground busbar 38 preferably extends outside the body 44 in direct proximity to the tower bolt receiving surface 52. In this fashion, the conductive connector bolt 54 provides a low resistance ground path by engaging the ground terminal end 42 and the conductive device shroud 14 after installation. In other embodiments, however, it is contemplated that the ground terminal end 42 may exit the conductive overmolded connector body 44 in any position suitable to provide a low resistance grounding path to the conductive device shroud 14. In such embodiments a variety of suitable connectors including spring loaded contact solutions may be utilized.

The conductive overmolded connector body 44 preferably further includes a outer shroud ring 56. The outer shroud ring 56 is configured to surround the conductive device shroud 14 when the connector plug portion 48 is inserted into the device plug receptacle 16. By overlapping the conductive device shroud 14, a longer path for noise waves is created and thus shielding performance is increased.

In addition to the outer shroud ring 56, the present invention contemplates the use of a connector seal element 58. In one embodiment, it is contemplated that the connector seal element 58 is conductive and thereby further increases shielding enhancement. The conductive connector seal element 58 closes potential leakage paths for high frequency noise and reduces resistance of the shield ground connection. A seal rim 60 feature may be formed in the connector plug portion 48 to provide a secure rest for the connector seal element 58. Additionally, a seal retainer element 62: may be used to secure that connector seal element 58 against the seal rim 60. The overlapping nature of the outer shroud ring 56 generates mating guides and true position features which maintain even compression of the connector seal element 58. The outer shroud ring 56 allows for utilization of softer seats thus reducing mating forces and improving seal performance. Tolerances are adjusted in such a way that the connector seal element 58 is not compressed beyond specified compression in any direction. This allows utilization of shear stress sensitive conductive seals 58 that would otherwise be damaged during uncontrolled mating processes.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A connector assembly for use with a device having a conductive device shroud forming a device plug receptacle, the connector assembly comprising:

at least one cable element comprising:

an internal cable conductor;

a cable conductor insulator surrounding said internal cable conductor;

a cable ground shield surrounding said cable conductor insulator;

a cable outer insulator surrounding said cable ground shield;

a first stripped cable end portion exposing said internal cable conductor;

a second stripped cable portion adjacent said first stripped cable end portion exposing said cable conductor insulator;

a third stripped cable portion adjacent said second stripped cable portion exposing said cable ground shield; and an unstripped cable portion adjacent said third stripped cable portion exposing said cable outer insulator;

a terminal element mounted to said first stripped cable end portion;

a ground busbar including a cable mount end and a ground terminal end, said cable mount end mounted to said third stripped cable portion;

a conductive overmolded connector body molded over said at least one cable element and extended between said second stripped portion and said unstripped portion, said conductive overmolded connector body comprising:

a wire arm surround portion covering at least a portion of said unstripped portion;

a connector plug portion covering at least a portion of said second stripped portion, said connector plug portion configured to fit within the device plug receptacle; and a connector bolt tower portion including a tower bolt receiving surface, said ground terminal end protruding outside said conductive overmolded connector body in proximity to said tower bolt receiving surface;

at least one conductive connector bolt positioned through said connector bolt tower portion, said at least one conductive connector bolt configured to retain said conductive overmolded connector body in contact with the device, said at least one conductive connector bolt configured to place said ground terminal end in electrical communication with the conductive device shroud.

2. A connector assembly as described in claim 1, wherein said overmolded connector body further comprises:

an outer shroud ring surrounding said connector plug portion.

3. A connector assembly as described in claim 2, wherein said outer shroud ring is configured to surround the conductive device shroud when said connector plug portion is positioned within the device plug receptacle.

4. A connector assembly as described in claim 1, further comprising:

a connector seal element surrounding said connector plug portion.

5. A connector assembly as described in claim 4, further comprising:

a seal rim formed in said connector plug portion and configured to engage said connector seal element.

6. A connector assembly as described in claim 5, further comprising:

a seal retainer element configured to slide over said connector plug portion and retain said connector seal element against said seal rim.

7. A connector assembly as described in claim 4, wherein said connector seal element comprises a conductive connector seal element.

8. A connector assembly as described in claim 1, wherein said terminal element is crimped onto said first stripped cable end portion.

9. A connector assembly as described in claim 1, wherein said ground busbar is crimped onto said third stripped cable position.

10. A connector assembly comprising:

a device including a conductive device shroud forming a device plug receptacle;

at least one cable element comprising:

a first stripped cable end portion exposing an internal cable conductor;

a third stripped cable portion exposing a cable ground shield;

a terminal element mounted to said first stripped cable end portion;

a conductive overmolded connector body molded over at least a portion of said at least one cable element, said conductive overmolded connector body covering at least a portion of said third stripped cable portion, said conductive overmolded connector body comprising:

a connector plug portion configured to fit within said device plug receptacle, said first stripped cable end portion protruding out of said connector plug portion, said cable ground shield placed in electrical communication with said conductive device shroud when said connector plug portion is placed within said device plug receptacle.

11. A connector assembly as described in claim 10 wherein said conductive overmolded connector body further comprises:

an outer shroud ring surrounding said connector plug portion.

12. A connector assembly as described in claim 11, wherein said outer shroud ring is configured to surround said conductive device shroud when said connector plug portion is positioned within said device plug receptacle.

13. A connector assembly as described in claim 10, further comprising:

a connector seal element surrounding said connector plug portion.

14. A connector assembly as described in claim 13, further comprising:

a seal rim formed in said connector plug portion and configured to engage said connector seal element.

15. A connector assembly as described in claim 13, further comprising:

a seal retainer element configured to slide over said connector plug portion and retain said connector seal element.

16. A connector assembly as described in claim 13, wherein said connector seal element comprises a conductive connector seal element.

17. A connector assembly as described in claim 10, wherein said terminal element is crimped onto said first stripped cable end portion.

18. A connector assembly as described in claim 10, further comprising:

a ground busbar including a cable mount end and a ground terminal end, said cable mount end mounted to said third stripped cable portion, said ground terminal end protruding outside said conductive overmolded connector body such that said ground terminal end is placed in electrical communication with said conductive device shroud when said connector plug portion is placed within said device plug receptacle.

19. A method of manufacturing a connector assembly comprising:

stripping at least one cable element to produce:

a first stripped cable end portion exposing an internal cable conductor; and a third stripped cable portion exposing a cable ground shield;

crimping a terminal element to said first stripped cable end portion;

crimping a ground busbar including a cable mount end and a ground terminal end to said third stripped cable portion;

overmolding a conductive overmolded connector body over at least a portion of said at least one cable element, said conductive overmolded connector body covering at least a portion of said third stripped cable portion, said conductive overmolded connector body comprising:

a connector plug portion configured to fit within a device plug receptacle, said first stripped cable end portion protruding out of said connector plug portion, said ground terminal end protruding outside said conductive overmolded connector body such that said ground terminal end is placed in electrical communication with a conductive device shroud when said connector plug portion is placed within said device plug receptacle.

20. A method as described in claim 19, wherein said conductive overmolded connector body further comprises:

an outer shroud ring surrounding said connector plug portion, said outer shroud ring configured to surround said conductive device shroud when said connector plug portion is positioned within said device plug receptacle.

* * * * *

UNITED STATES PATENT AND TRADEMARK OFFICE

CERTIFICATE OF CORRECTION

PATENT NO. : 7,393,218 B1
APPLICATION NO. : 11/687979
DATED : July 1, 2008
INVENTOR(S) : Slobadan Pavlovic and David S. Menzies It is certified that error appears in the above-identified patent and that said Letters Patent is hereby corrected as shown below:

Column 4, line 34: After “stripped” insert --cable--.

Column 4, line 34: After “unstripped” insert --cable--.

Column 4, line 54: Before “overmolded” insert --conductive--.

Column 5, line 15: After “cable” insert --end--.

Column 5, line 16: Delete “position” and replace with --portion--.

Signed and Sealed this

Eighth Day of December, 2009

David J. Kappos

David J. Kappos
*Director of the United States Patent and Trademark Office*